US005291839A

United States Patent [19]

Wong

[11] Patent Number: 5,291,839

[45] Date of Patent: Mar. 8, 1994

[54] COMBUSTION APPARATUS FOR TREATING WASTES

[76] Inventor: Ming Y. Wong, No. 3, Lane 59, Hsin Chien Rd., Tainan, Taiwan

[21] Appl. No.: 928,257

[22] Filed: Aug. 11, 1992

[51] Int. Cl.[5] ..... F23G 5/02

[52] U.S. Cl. ..... 110/222; 110/250

[58] Field of Search ..... 110/235, 241, 248, 250, 110/346, 222

[56] References Cited

U.S. PATENT DOCUMENTS

| | | | |
|---|---|---|---|
| 2,783,723 | 3/1957 | Loewenthal et al. | 110/250 |
| 2,854,557 | 9/1958 | Triggs | 110/250 |
| 3,788,243 | 1/1974 | Eff | 110/250 |
| 3,882,797 | 5/1975 | Eff | 110/250 |
| 5,000,101 | 3/1991 | Wagner | 110/250 |
| 5,022,328 | 6/1991 | Robertson | 110/222 |
| 5,090,340 | 2/1992 | Burgess | 110/250 |

*Primary Examiner*—Henry C. Yuen

*Attorney, Agent, or Firm*—Robbins, Berliner & Carson

[57] ABSTRACT

A combustion device for treating wastes is suitable for family use and includes a barrel disposed in a body for accommodating the wastes, an inner wall fixed in the barrel, a heating coil disposed between the inner wall and the body for heating and combusting the wastes, a motor disposed in the body, and a rotatable blade fixed on the spindle of the motor for comminuting the wastes when the motor is energized.

5 Claims, 4 Drawing Sheets

COMBUSTION APPARATUS FOR TREATING WASTES

BACKGROUND OF THE INVENTION

1. Field of the Invention

The present invention relates to a combustion apparatus, and more particularly to a combustion apparatus for treating wastes, particularly the combustible wastes.

2. Description of the Prior Art

Typical incinerators which are provided for treating wastes are generally the incinerators of great bulk. As far as applicant is aware, no combustion apparatus of small sizes are provided for family use and for treating family wastes.

The present invention has arisen to provide a novel combustion apparatus for treating wastes.

SUMMARY OF THE INVENTION

The primary objective of the present invention is to provide a combustion apparatus for treating wastes which has a small size and is particularly suitable for family use.

In accordance with one aspect of the invention, there is provided a combustion device for treating wastes comprising a body, a cover pivotally engaged on an upper portion of the body for covering the body, a barrel disposed in the body for accommodating the wastes, a lid fixed in the cover for covering the barrel, heating means disposed in the barrel for combusting the wastes, and comminuting means disposed in the body and located below the barrel for comminuting the wastes, and a container disposed in a lower portion of the body for collecting the wastes after combustion processes and after comminuting processes.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
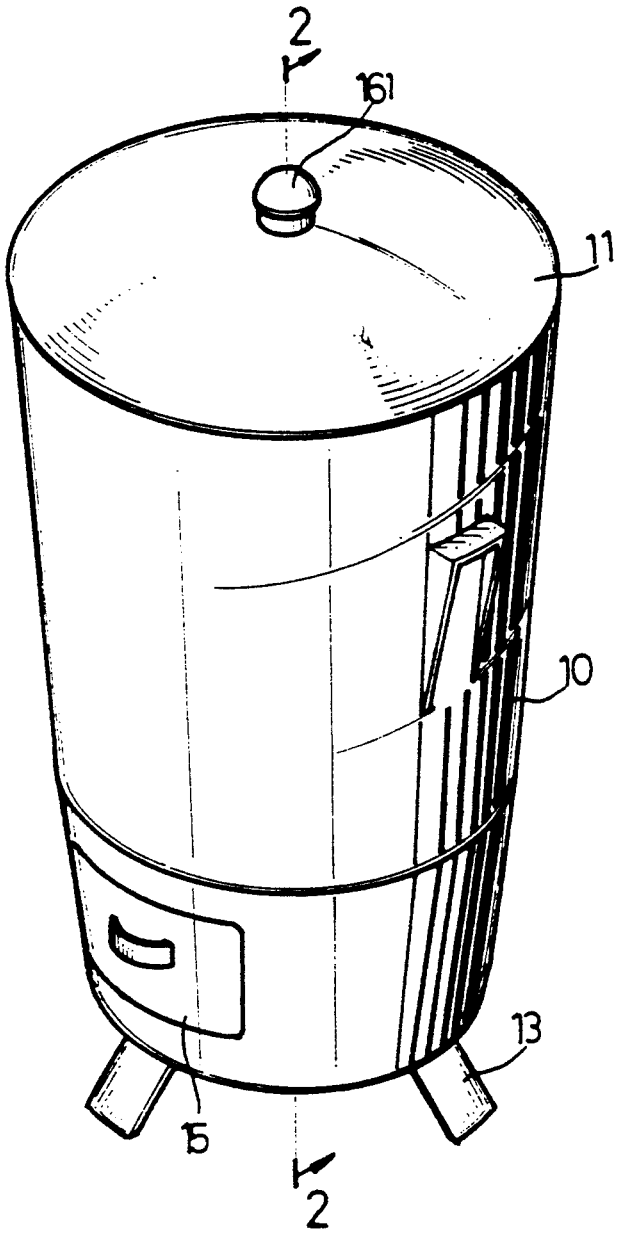
FIG. 1 is a perspective view of a combustion apparatus in accordance with the present invention.
Figure 2:
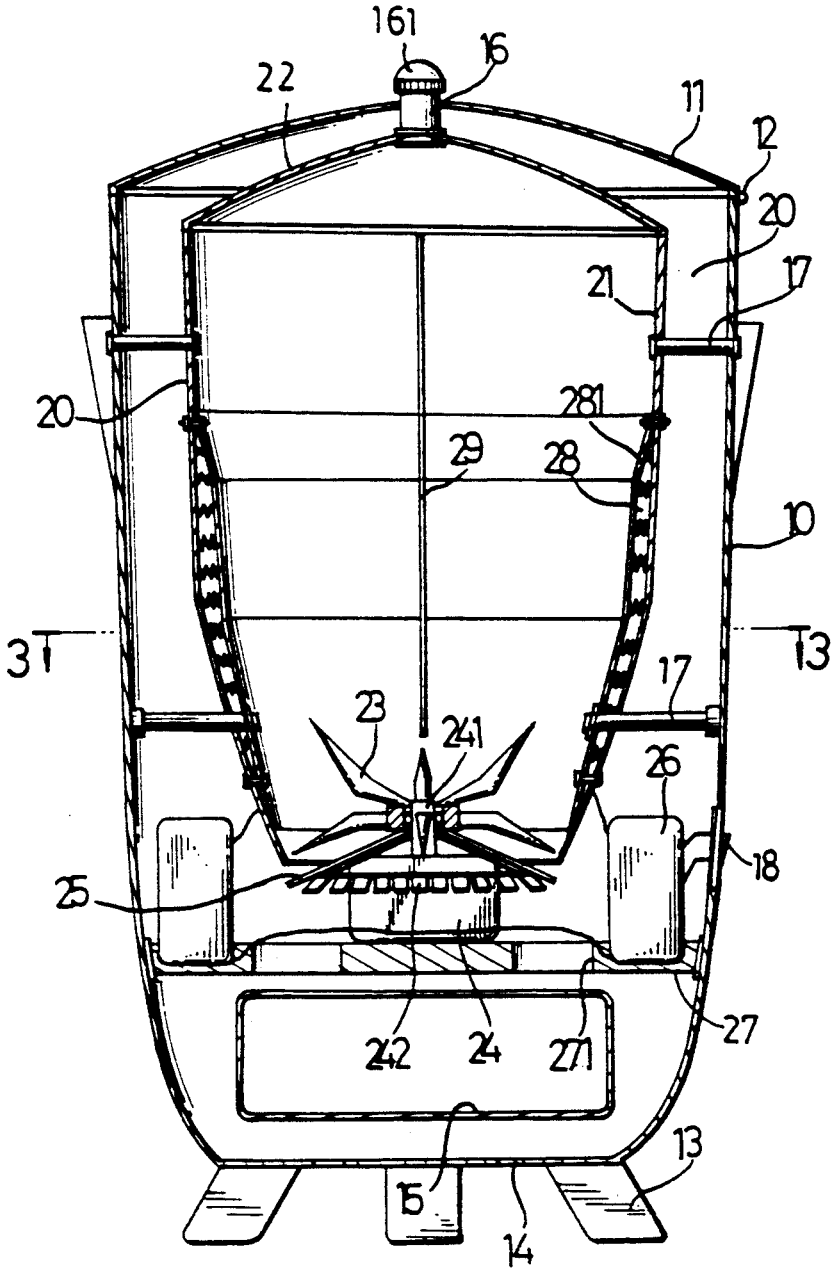
FIG. 2 is a cross sectional view taken along lines 2—2 of FIG. 1.
Figure 3:
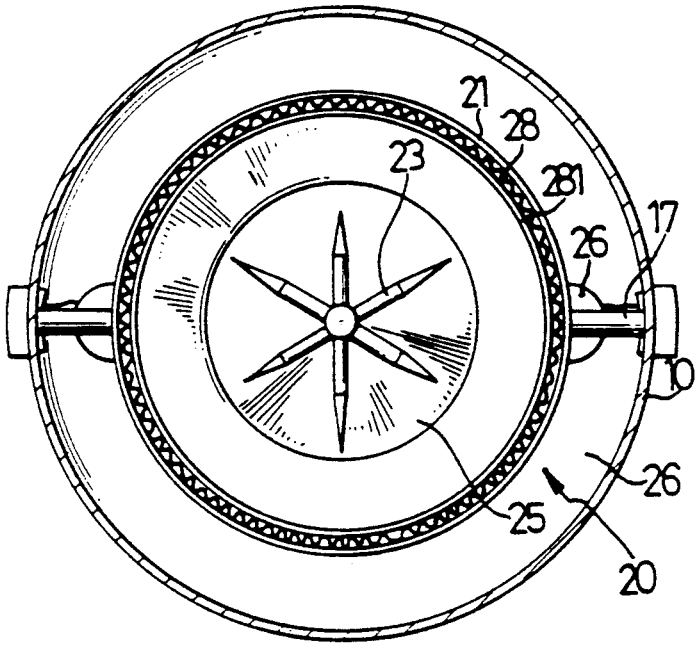
FIG. 3 is a cross sectional view taken along lines 3—3 of FIG. 2.

Referring to the drawings, and initially to FIGS. 1 to 3, a combustion apparatus in accordance with the present invention comprises generally a body 10 having a cover 11 pivotally coupled on the top thereof by a hinge 12 and having leg members 13 disposed on the bottom portion thereof, air holes 14 formed in the bottom of the body 10, a drawer or a container 15 disposed in the lower portion of the body 10, a barrel 20 fixed in the body 10 by rods 17 and preferably made of fire resisting materials, or, alternatively, the barrel 20 having a lining 21 formed in the inner peripheral portion of the barrel 20, and a lid 22 fixed in the cover 11 for covering the barrel 20, the lid 22 being fixed to the cover 11 by a pin element 16 which has a knob 161 formed on the outer portion thereof so that the cover 11 and the lid 22 can be opened. The wastes, particularly the combustible wastes to be treated are disposed in the barrel 20.

A heating means is fixed in the inner and lower portion of the barrel 20 and includes an inner wall 281 fixed to the barrel 20 and a heating coil 28 disposed between the inner wall 281 and the barrel 20 for heating and combusting the combustible wastes disposed in the barrel 20. The inner wall 281 is made of heat conductive materials. At least one rib 29 is formed in the inner portion of both the barrel 20 and the inner wall 281. A rotatable comminutor/blender blade 23 is fixed to the spindle 241 of a motor 24 for comminuting both the combustible wastes before combustion processes and the ash formed from the wastes after combustion processes. A cap 25 is disposed above the motor 24 for shielding the motor 24 and includes a plurality of fins 242 depended therefrom. The motor 24 is disposed on a board 27 which includes one or more openings 271 formed therein so that the ash may be collected in the container 15. One or more capacitors 26 are disposed on the board 27 and connected between the heating coil 28 and a socket 18, the socket 18 may be connected to an electric source for energizing the heating coil 28. Alternatively, the heating coil 28 may be directly connected to the electric source.

Figure 4:
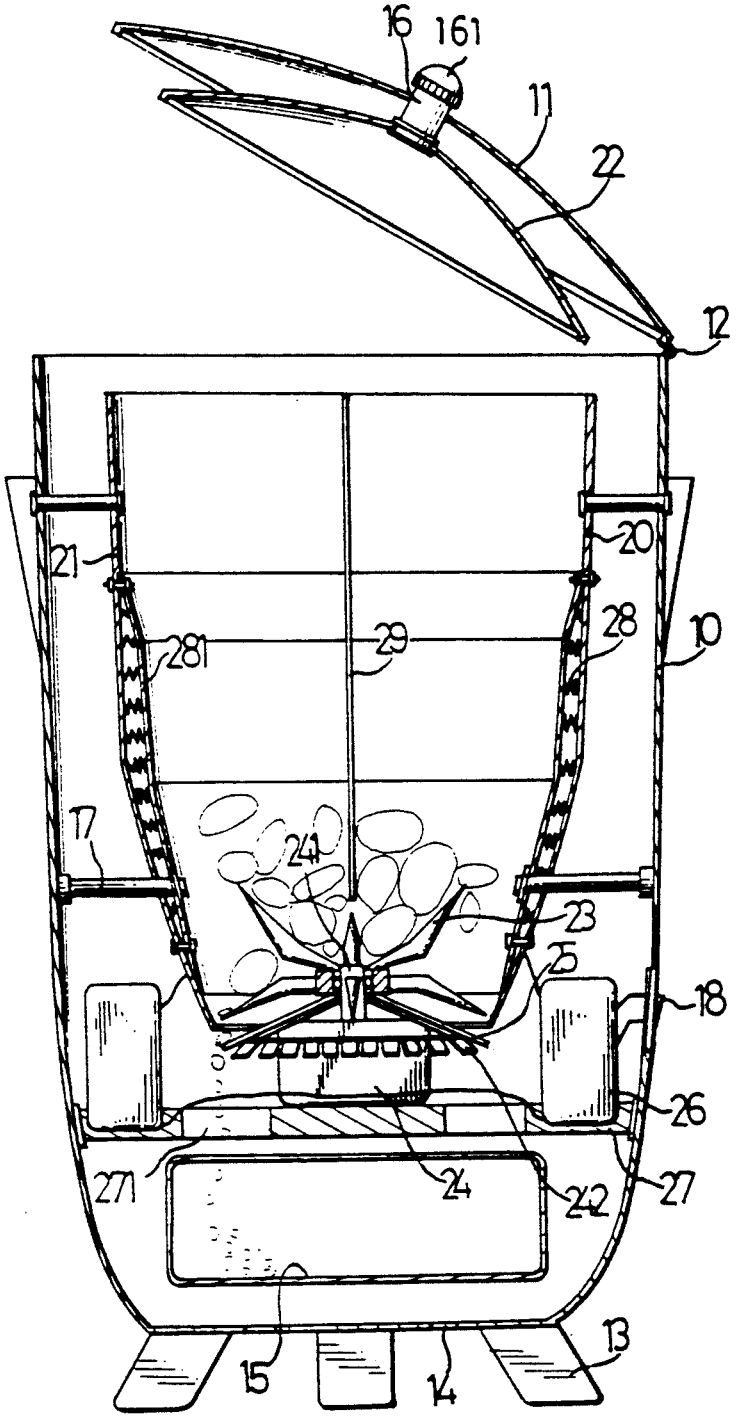
FIG. 4 is a cross sectional view similar to FIG. 2, illustrating the operations of the combustion apparatus.

In operation, referring next to FIG. 4, the combustible wastes are disposed in the barrel 20 and heated and combusted by the heating means, the combustible wastes both before combustion processes and after combustion processes are comminuting by the blades 23, such that the wastes, particularly the wastes in ash form may pass through the openings 271 and may be collected within the container 15. The collected ash can be used as fertilizer.

Accordingly, the combustion apparatus for treating wastes in accordance with the present invention is particularly suitable for family use, such that family wastes can be greatly decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A combustion apparatus for treating wastes comprising:

a body;

a barrel disposed in the body for accommodating said wastes;

heating means disposed in said barrel for combusting said wastes;

a motor which is disposed in said body and comprises a spindle and a rotatable blade fixed on said spindle for comminuting said wastes when said motor is energized; and a cap which is disposed above said motor for shielding said motor and comprises a plurality of fins depended therefrom.

2. A combustion apparatus according to claim 1, wherein said heating means includes an inner wall fixed in an inner and lower portion of said barrel, and a heating coil disposed between said inner wall and said body for heating and combusting said wastes.

3. A combustion apparatus for treating wastes comprising:

a body;

a cover pivotally engaged on an upper portion of said body for covering said body;

a barrel disposed in the body for accommodating said wastes, a lid fixed in said cover for covering said barrel;

heating means disposed in said barrel for combusting said wastes;

a motor which is disposed in said body and comprises a spindle and a rotatable blade fixed on said spindle for comminuting said wastes when said motor is energized;

a cap which is disposed above said motor for shielding said motor and comprises a plurality of fins depended therefrom; and a container disposed in a lower portion of said body for collecting said wastes after combustion processes and after comminuting processes.

4. A combustion apparatus according to claim 3, wherein said heating means includes an inner wall fixed in an inner and lower portion of said barrel, and a heating coil disposed between said inner wall and said body for heating and combusting said wastes.

5. A combustion apparatus for treating wastes comprising:

a body;

a barrel disposed in the body for accommodating said wastes; and inner wall fixed in an inner and lower portion of said barrel;

a heating coil disposed between said inner wall and said body for combusting said wastes;

a motor which is disposed in said body and comprises a spindle;

a rotatable blade fixed on said spindle for comminuting said wastes when said motor is energized; and a cap which is disposed above said motor for shielding said motor and comprises a plurality of fins depended therefrom.

* * * * *